United States Patent [19]

Kessler et al.

[11] 4,138,316

[45] Feb. 6, 1979

[54] FABRIC STRINGING METHOD FOR NON-CANTILEVERED FOURDRINIER MACHINE

[75] Inventors: Norbert Kessler, Baldwinsville; John M. Robbins, Fulton, both of N.Y.

[73] Assignee: The Black Clawson Company, Middletown, Ohio

[21] Appl. No.: 881,375

[22] Filed: Feb. 27, 1978

[51] Int. Cl.[2] ..... D21F 1/26

[52] U.S. Cl. ..... 162/200; 162/273

[58] Field of Search ..... 162/200, 273

[56] References Cited

U.S. PATENT DOCUMENTS

Re. 21,381 3/1940 Pederson ..... 162/200

2,290,087 7/1942 Berry et al. ..... 162/200

*Primary Examiner*—Richard V. Fisher

*Attorney, Agent, or Firm*—Biebel, French & Nauman

[57] ABSTRACT

Fabric changes at the forming section of non-cantilevered, fourdrinier, paper making machines are simplified through use of one or more C-shaped carriages which carry the new fabric and support the front framing of the machine to allow spacer blocks which normally support the front framing to be removed. This provides a gap extending the length of the forming section through which the new fabric may be moved into place and strung into operating position. Thereafter the spacer blocks are replaced and the carriages removed.

10 Claims, 5 Drawing Figures

FABRIC STRINGING METHOD FOR NON-CANTILEVERED FOURDRINIER MACHINE

BACKGROUND OF THE INVENTION

Fourdrinier paper making machines include a forming section which is defined by an endless foraminous belt, which is trained about a plurality of table rolls and usually suction boxes and other water removing devices to form a flat drainage surface onto which a slurry of paper making fibers and liquid is deposited, a series of tensioning and return rolls positioned beneath the forming surface, and breast and couch rolls positioned adjacent the upstream and downstream ends, respectively, of the forming surface.

The forming section of a paper making machine can vary substantially in size from under 100 inches to over 400 inches in width and over 100 feet in length. The replacement of the foraminous belt, commonly called a "fabric" or "wire", can be an expensive and time consuming operation.

One approach to this task has been to manufacture the machine such that all of the rollers, suction boxes and other liquid removing elements can be removed so that the fabric can be slipped over the ends of the rollers remaining and the elements which were removed reinserted within the loop of the fabric. Obviously such an approach is extremely expensive in terms of both the length of time a machine is out of operation and the amount of labor required to perform a fabric change.

Another more recent approach is to form the framing of the fourdrinier as a cantilever. A fourdrinier constructed in this manner is manufactured with supporting beams of sufficient strength so that, when properly anchored back of the machine, they can support the forming section as a cantilevered load during a fabric change. The front side framing is provided with supporting blocks which can be removed to allow a new fabric to be positioned on the machine.

Although the cantilever approach greatly facilitates the fabric change operation itself it will be apparent that because of the loads imposed on the machine and its foundation during fabric change the capital costs involved are substantial as compared to a non-cantilevered machine.

SUMMARY OF THE INVENTION

The present invention provides a wire changing system for use with non-cantilevered machines which permits relatively rapid fabric changes without the disadvantage of increased capital costs associated with cantilevered type fourdrinier machines.

In accordance with the present invention one or preferably a pair of substantially C-shaped carriages are provided which carry the fabric as it is moved into position adjacent the side of the machine and then support the side framing of the machine while the normal support blocks are removed.

The lower or base leg of the C-shaped carriage has mounted thereon rollers adjacent its free end and has its opposite end connected to the upper, supporting leg of the carriage. The roller adjacent the free end of the lower base leg of the carriage is vertically movable. When the carriage is moved into position to engage the side framing of the machine the roller is moved upwardly so that support of the carriage is transferred from that roller directly to the machine sole plate or foundation at that end.

The upper support leg of the carriage has a jack mounted at its outer end which can be positioned beneath the side framing and extended to lift the side framing and allow the support blocks to be removed. Removal of the support blocks provide a gap extending the length of the machine through which the bottom loop of the fabric may be inserted.

Prior to moving the carriage or carriages into supporting engagement with the side framing of the machine the fabric is mounted on the carriage or carriages with the lower loop of the fabric positioned between the base and support legs and the upper loop of the fabric disposed above the upper support leg. Preferably the lower support leg will be provided with a circular carrying bar which actually engages the lower loop of the fabric to provide a smooth surface and decrease the chance of damage to the fabric.

Also, a pair of such carrying bars are mounted on arms extending outwardly and upwardly from opposite sides of the upper support leg and engage the upper loop of the fabric to position it above the upper support leg. Thus, when the carriage or carriages are moved into supporting engagement with the side framing of the machine, the fabric is carried by the carriage or carriages with the upper support leg received within the loop of the fabric.

Particularly in the case of non-metallic fabrics, which comprise the majority of fabrics being installed today, the length of the upper and lower legs of the C-shaped carriage can be reduced in half by first folding or bundling the fabric to compact its width. After the side framing of the machine is supported by the carriages the fabric can be drawn out to its full width as it is installed on the machine.

From the above and the following detailed description, it will be seen that the present invention provides method and apparatus which facilitate fabric change on a fourdrinier machine without the necessity of resorting to a permanent cantilever structure.

DESCRIPTION OF THE PREFERRED EMBODIMENT

Figure 1:
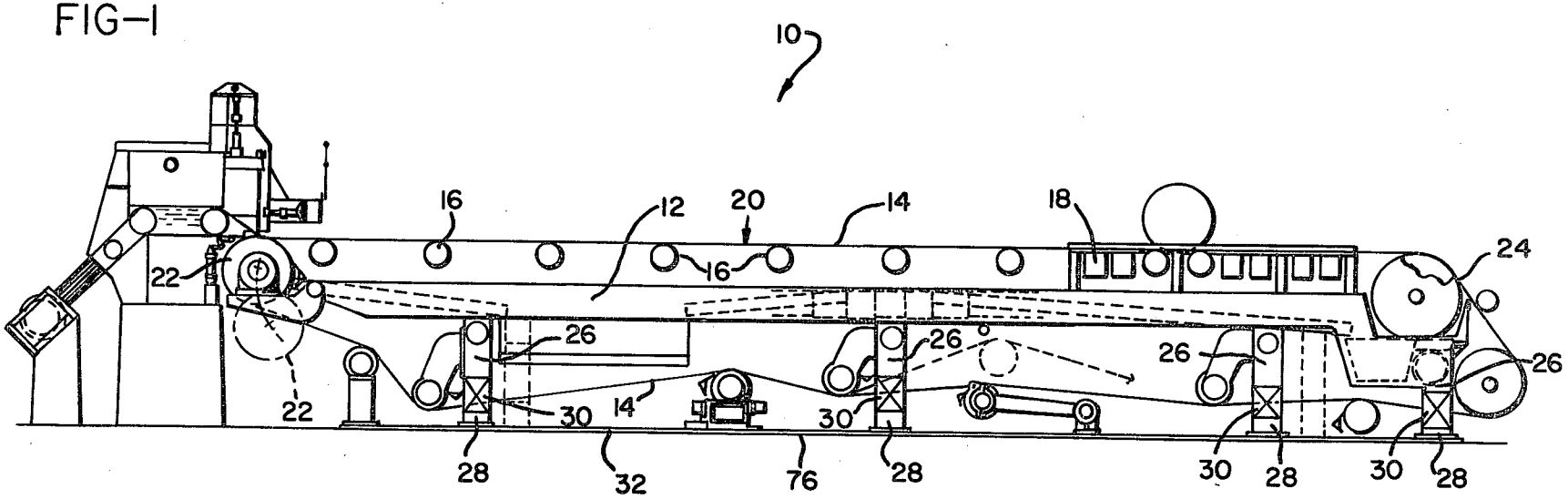
FIG. 1 is a side elevational view of a non-cantilevered fourdrinier.
Figure 2:
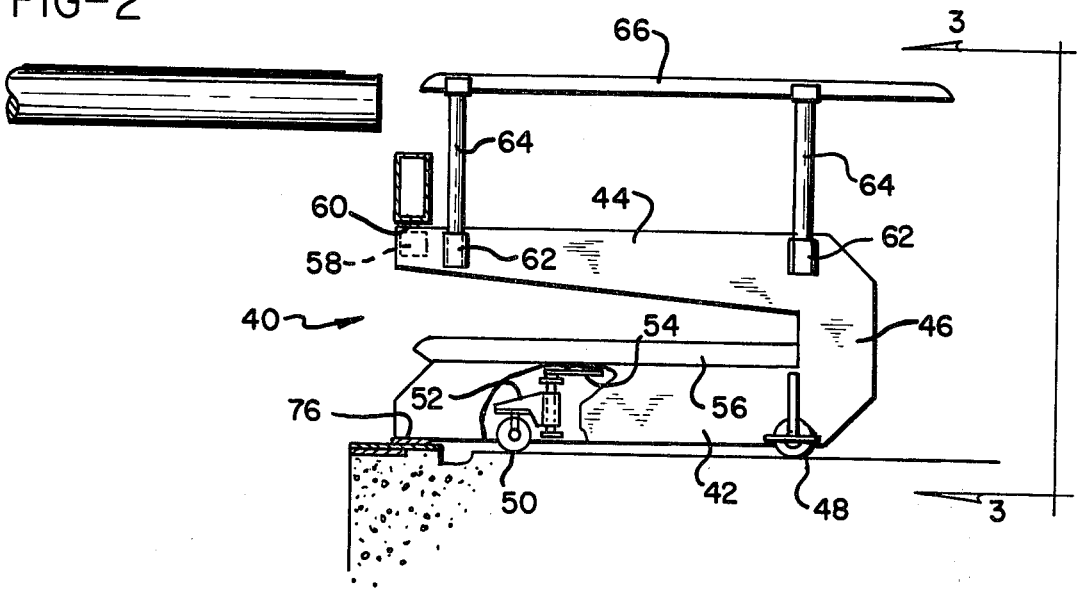
FIG. 2 is a side elevational view of a carriage in accordance with the present invention and a portion of the fourdrinier of FIG. 1.

FIG. 1 shows a fourdrinier type paper making machine 10 including side framing 12, a continuous loop drainage fabric 14 trained around a series of table rolls 16, suction boxes 18 and other liquid removing equipment to define a substantially horizontal forming surface 20 through which liquid in the paper making slurry drains as it is carried downstream from adjacent the breast roll 22 to the couch roll 24.

A series of vertically extending structural members 26 are secured to the side frame 12 and aligned with upwardly extending vertical structural members 28 with spacer blocks 30 interposed between the two and transferring the weight of the front side of the fourdrinier machine shown in FIG. 1 to the foundation 32. The fabric 14 may be a fine mesh metal wire screen, but more commonly in modern practice a plastic foraminous material is utilized. In either case the fabric 14 eventually wears or is damaged and is removed from the machine and must be then replaced with a new fabric. The fabric may also, at times, be removed to provide access to the forming section elements for maintenance and subsequently reinstalled for greater economy. The problems and difficulties encountered in fabric replacement are discussed above. These are obviated through the use of the method and apparatus of the present invention.

Thus, as seen in FIGS. 2 through 5, the apparatus of the present invention includes a generally C-shaped carriage 40 which includes a lower base leg 42 and an upper support leg 44 rigidly attached by a vertical structural member 46 adjacent the rear ends of the two legs. The leg 42 is provided at its rear end with a pair of rollers 48 and, adjacent its front end with a single roller 50.

Roller 50 is carried by a vertically adjustable bracket 52 which is operable by a manually operated ratchet mechanism 54 to raise and lower the wheel 50 with respect to the lower leg 42 and thereby transfer the load carried by the wheel 50 to the leg 42 itself. Lower leg 42 also has mounted thereon a circular carrying bar 56 which provides a smooth supporting surface for the fabric.

At its forward end the upper leg 44 has mounted thereon a jack 58 including a vertically movable piston 60. Brackets 62 are mounted on both sides of the upper leg 44 adjacent both its front and rear ends and receive arms 64 which extend upwardly and outwardly above the upper leg 44. The arms 64 support essentially round carrying bars 66 which, similarly to the bar 56, provide a smooth supporting surface for the fabric.

Figures 4, 5:
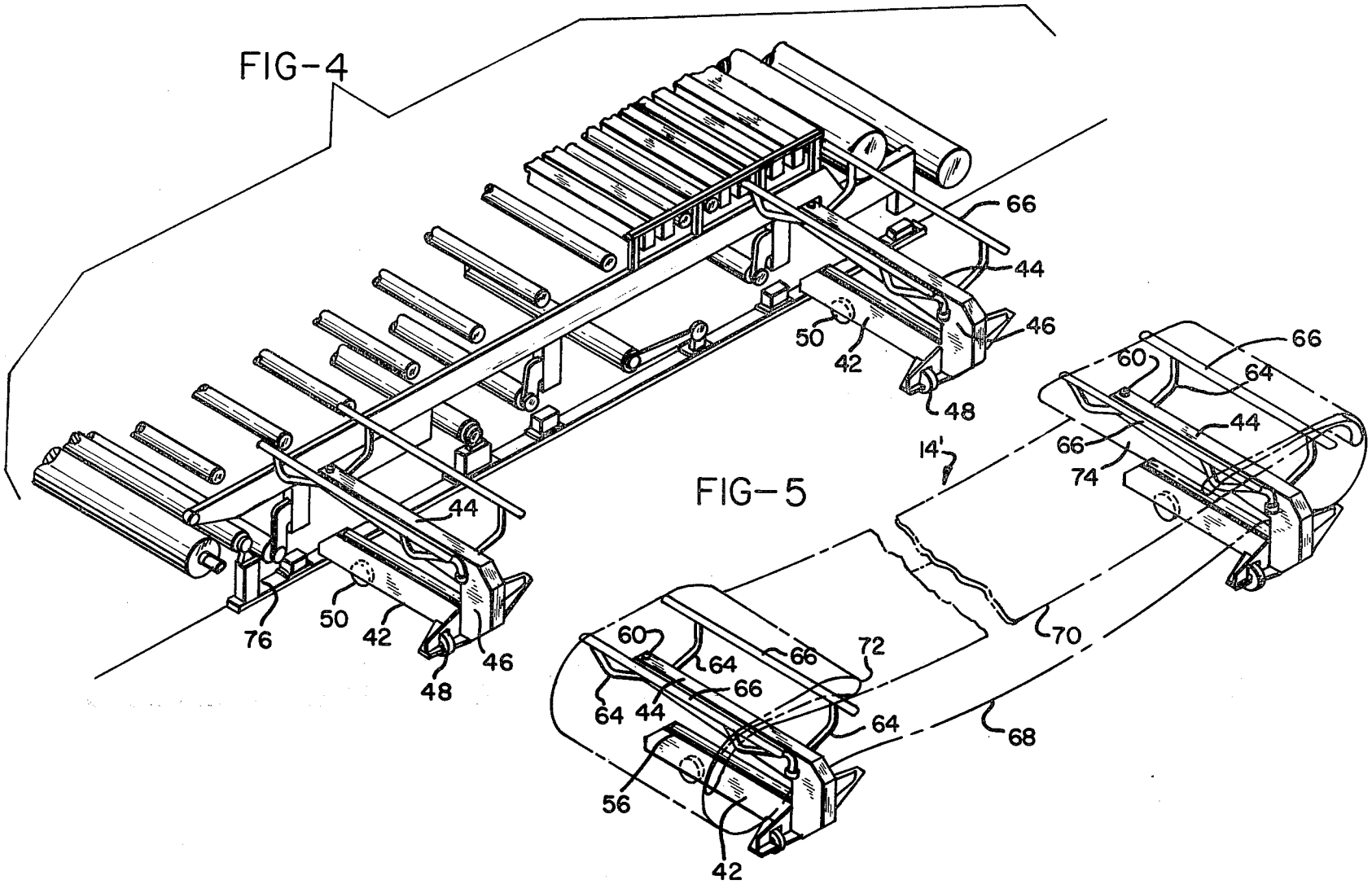
FIG. 4 is a perspective view showing a pair of carriages in supporting engagement with the side framing of a fourdrinier but with the fabric removed for purposes of clarity.
FIG. 5 is a perspective view showing a pair of carriages carrying a fabric prior to the carriages being moved into the position shown in FIG. 4.

In operation, after the worn out fabric has been removed the new fabric is positioned on the carriages as shown schematically in FIG. 5 of the drawings. While a pair of carriages are shown in FIGS. 4 and 5 and in fact the use of a pair of carriages on most fourdrinier machines will prove advantageous, it will be apparent as the description proceeds that a single carriage might be used instead.

It will also be noted from FIG. 5 of the drawings that the new fabric 14' has been folded lengthwise to permit carriages of a shorter length to be used. Particularly where non-metallic fabrics are being installed, folding, bunching or bundling the fabric lengthwise as shown in FIG. 5 is not harmful to the fabric.

Figure 3:
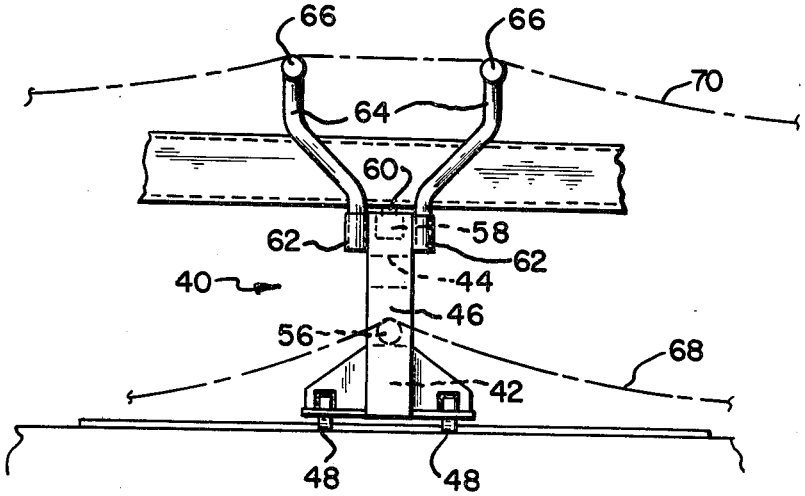
FIG. 3 is a view taken on line 3—3 of FIG. 2.

In positioning the fabric on the carriages it will be noted that the upper leg 44 is inserted through the loop of the fabric with the lower portion of the fabric loop 68 resting on the carrying bars 56 mounted on the lower leg 42. The upper loop 70 of the fabric rests on the upper carrying bars 66 as best seen in FIGS. 3 and 5 of the drawings. Excess material at each end of the fabric loop which will later be positioned about the breast roll at one end and the couch and turning rolls at the other end of the machine are folded up over the top loop as seen at 72 and 74 in FIG. 5 of the drawings.

The breast roll will generally be capable of movement to a lower position, as indicated by the solid and dotted lines in FIG. 1 of the drawings, and it will be moved to its lower position as shown in FIG. 4 of the drawings prior to installing the new fabric 14'. The carriages 40 are then rolled forward until the jacks 58 are positioned beneath the side framing member 12.

Rollers 50 are then raised so that the front ends of the carriages lower legs are resting on the base plate 76 running beneath the side framing member 12. Thereafter jacks 58 are actuated, raising the side framing member 12 slightly to permit the blocks 30 to be removed. The machine and carriages are then as shown in FIG. 4 of the drawings except that the fabric has been removed for purposes of clarity.

It will be seen that a gap now exists extending the length of the machine beneath the side framing member 12. Through this gap the lower loop 68 is moved while the upper loop 70 is moved over the side framing member 12 and the associated liquid removing devices. The fabric is then strung in position about the various liquid removing devices, breast, couch, turning and tension rolls associated with the machine. Of course the fabric, if folded longitudinally, is unfolded as it is positioned on the machine.

Thereafter, the blocks 30 are replaced, the jacks 58 depressurized, the wheels 50 lowered to carry the front ends of the carriages, and the carriages then rolled clear of the machine.

From the above it will be apparent that the present invention provides an improved method and apparatus for overcoming the difficulties and disadvantages associated with prior art fourdrinier fabric changes.

While the method herein described, and the form of apparatus for carrying this method into effect, constitute preferred embodiments of the invention, it is to be understood that the invention is not limited to this precise method and form of apparatus, and that changes may be made in either without departing from the scope of the invention.

What is claimed is:

1. A method of installing a continuous loop drainage fabric on a non-cantilevered fourdrinier machine comprising:

mounting a fabric on carriage means having support means with said support means received within the loop of said fabric, positioning said carriage means with said support means thereof in supporting engagement with side framing of said machine, removing supporting blocks from said framing of said machine to form a gap extending the length of said machine, moving said fabric transversely of the length thereof with a lower portion of said loop thereof passing through said gap and an upper portion of said loop thereof passing above said framing, stringing said fabric in its operating position, replacing said supporting blocks, and removing said carriage means from supporting engagement with said framing.

2. The method of claim 1 wherein said step of mounting a fabric on said carriage means includes:

compacting said fabric lengthwise thereof to reduce the width thereof.

3. The method of claim 2 wherein said step of stringing said fabric includes:

opening said fabric to the full width thereof.

4. The method of claim 2 wherein said step of compacting said fabric comprises:

folding said fabric lengthwise.

5. The method of claim 2 wherein said step of compacting said fabric comprises:

bunching said fabric on said carriage means.

6. The method of claim 1 wherein said step of positioning said carriage means includes:

positioning jacks carried by said support means beneath said side framing and actuating said jacks to raise said side framing.

7. The method of claim 1 wherein said step of mounting a fabric on said carriage means includes:

folding opposite ends of said fabric over said carriage support means.

8. The method of claim 1 wherein said carriage means includes a plurality of carriages and said mounting of said fabric on said carriage means includes:

positioning said support means of each of said carriages within the loop of said fabric.

9. The method of claim 1 wherein said carriage means includes roller means for moving said carriage means towards and away from said machine and said positioning step includes:

rolling said carriage means into position with said support means beneath said side framing and lifting said roller means whereby said carriage means is no longer supported by said roller means.

10. A method of installing a continuous loop drainage fabric on a non-cantilevered fourdrinier machine comprising:

providing a pair of substantially C-shaped carriages each having an upper support means and a lower base means extending beneath said upper support means in spaced relationship thereto, positioning said carriages adjacent the side of the fourdrinier machine, folding a continuous loop fabric substantially in half longitudinally, inserting a lower portion of said loop between said support means and said base means while an upper portion of said loop is positioned above said support means, rolling both said carriages toward said machine until said support means thereof are positioned beneath said side framing of said machine, activating jack means carried by each support means to lift said side framing, removing supporting blocks from said framing of said machine to form a gap extending the length of said machine beneath said framing, moving said fabric transversely of the length thereof with said lower portion of said loop passing through said gap and said upper portion of said loop passing over said framing, unfolding said fabric to provide a single thickness loop, stringing said unfolded fabric to its operating position, replacing said support blocks, deactivating said jack means, and rolling said carriages away from said machine.

* * * * *